United States Patent [19]

Inoue et al.

[11] Patent Number: 4,803,146

[45] Date of Patent: Feb. 7, 1989

[54] METHOD TO FORM IMAGE FOR SILVER SALT DIFFUSION TRANSFER USING FOGGING AGENT

[75] Inventors: Noriyuki Inoue; Yoshio Idota; Morio Yagihara, all of Kanagawa, Japan

[73] Assignee: Fuji Photo Film Co., Ltd., Kanagawa, Japan

[21] Appl. No.: 110,300

[22] Filed: Oct. 20, 1987

[30] Foreign Application Priority Data

Oct. 20, 1986 [JP] Japan ..... 61-248967

[51] Int. Cl.[4] ..... G03C 5/54

[52] U.S. Cl. ..... 430/248; 430/230; 430/233; 430/244; 430/249

[58] Field of Search ..... 430/230, 227, 233, 244, 430/248, 249

[56] References Cited

U.S. PATENT DOCUMENTS

| | | | |
|---|---|---|---|
| 4,035,185 | 7/1977 | Evans et al. | 430/230 |
| 4,144,064 | 3/1979 | Vermeulen et al. | 430/244 |
| 4,149,889 | 4/1979 | Yoshida et al. | 430/230 |
| 4,175,965 | 11/1979 | Yoshida et al. | 430/230 |
| 4,306,016 | 12/1981 | Baralle et al. | 430/598 |
| 4,309,499 | 1/1982 | Takagi et al. | 430/230 |
| 4,471,044 | 9/1984 | Parton et al. | 430/598 |

*Primary Examiner*—Richard L. Schilling

*Attorney, Agent, or Firm*—Sughrue, Mion, Zinn, Macpeak & Seas

[57] ABSTRACT

A method for forming an image with diffusion transfer of silver salts comprising processing a photosensitive element in the presence of a fogging agent.

9 Claims, No Drawings

METHOD TO FORM IMAGE FOR SILVER SALT DIFFUSION TRANSFER USING FOGGING AGENT

FIELD OF THE INVENTION

The present invention relates to a method to form an image by diffusion transfer of silver salt.

BACKGROUND OF THE INVENTION

A method to form an image by diffusion transfer using a silver salt such as silver halide or the like is publicly-known. Such a known method may comprise, for example, treating a photosensitive silver halide emulsion layer after being subjected to image exposure with an alkaline aqueous solution containing a developing agent, a solvent for a silver halide, and a film forming agent (a viscosity increasing agent) to reduce exposed silver halide grains with the developing agent to silver and, on the other hand, to change unexposed silver halide grains into transferable silver complex salts with the solvent for silver halide; diffusion transferring the silver complex salt to a layer (an image receiving layer) containing a precipitant for silver which is superposed on the above-mentioned emulsion layer by imbibition; and reducing the silver complex salt by use of the developing agent with the help of the precipitant for silver to form a silver image in the image receiving layer.

In carrying out the method, for example, a film unit is used which is prepared by combining a photosensitive element having a photosensitive silver halide emulsion layer disposed usually on a substrate, an image receiving element having an image receiving layer containing a precipitant for silver disposed on a substrate, and a processing element comprising a rupturable container housing an active alkaline aqueous solution containing a developing agent, a solvent for silver halide, and a film forming agent. After imagewise exposure of the emulsion layer of the photosensitive element, the photosensitive element and the image receiving element are superposed on each other with the emulsion layer facing the image receiving layer of the image receiving element, and then the two elements are run through a pair of rolls to rupture the processing element between the two rolls so that a viscous alkaline aqueous solution is formed between the elements. After that, the two elements are allowed to stand for a prescribed time before the image receiving element is stripped from the photosensitive element, and thus, a print having a desired image formed on the image receiving layer can be obtained.

In general, a method to form an image for diffusion transfer of silver salt has deffects that, when a developing time increases, the maximum density is lowered and at the same time, gradation of high density part becomes hard. That is, it has been found that when the developing time is increased, or the release time is increased in the case of release type photographic material, the silver amount in a part of the image receiving layer corresponding to the unexposed part of silver halide increases but a silver mirror reaction occurs markedly and surface reflection is caused remarkably, reducing the maximum density.

SUMMARY OF THE INVENTION

A first object of the invention is to provide a method to form an image by diffusion transfer of silver salt which method is free from a lowering in the maximum density and also from hardening of gradation of high density part even when the developing time is increased.

A second object of the invention is to provide a method to form an image by diffusion transfer of silver salt which method is substantially free from occurrence of the above described silver mirror reaction even when the developing time is increased.

A third object of the invention is to provide a release type silver salt diffusion transfer method which method produces an image free from change in maximum density and in the gradation of the high density part even when the release time is increased.

A fourth object of the invention is to provide a photosensitive element for a silver salt diffusion transfer method which element is substantially free from change in maximum density and in the gradation of the high density part even when the release time is increased.

Problems mentioned above have now been solved by a method to form an image for diffusion transfer of silver salts which method comprises treating a photosensitive element in the presence of a fogging agent. The fogging agent herein means a compound capable of chemically fogging a silver halide emulsion, as defined in "Photographic Terms Dictionary", a publication edited by the committee of photographic terms of Japanese Photographic Society, at p. 49.

DETAILED DESCRIPTION OF THE INVENTION

Various fogging agents can be used, and it is especially preferred to use those having no adsorptivity (or relatively weak adsorptivity) for silver halides and capable of diffusing readily, or those having no adsorptivity for silver halides and having low diffusibility in a relatively large amount. However, on the other hand, it is sufficient to use those having adsorptivity (relatively strong adsorptivity) for silver halides in a small amount.

A fogging agent used in the invention can be contained in the photosensitive element or in the processing element and it is preferably contained in the photosensitive material.

If a fogging agent is contained in the photosensitive material, it is preferred to add it to a silver halide emulsion (preferably a negative type silver halide emulsion) layer, but it may be added to another layer, for example, an intermediate layer, an undercoat layer, or a backing layer, so long as it diffuses during a coating process or during a treatment process to be adsorbed on silver halide.

If a fogging agent having adsorptivity is contained in a photosensitive element, the amount used is preferably $10^{-8}$ to $10^{-3}$ mol, and more preferably $10^{-7}$ to $10^{-4}$ mol per mol of silver halide.

The amount of fogging agent without adsorptivity used is preferably $10^{-7}$ to $10^{-2}$ mol, more preferably $10^{-5}$ to $10^{-2}$ mol per mol of silver halide.

Further, if a fogging agent is contained in a processing composition, the amount used is $10^{-5}$ to $10^{-1}$ mol, more preferably $10^{-4}$ to $10^{-2}$ mol per liter of the composition.

Two or more of these fogging agents may be used in the form of a combination. Further, it is possible to use, as a fogging agent, compounds mentioned as a nucleating agent, for example, in *Research Disclosure,* No. 22534 (January, 1983), pages 50–54, ibid, No. 15162 (November, 1976), pages 76–77, and ibid, No. 23510 (November, 1983), pages 346–352.

Compounds represented by the general formula (I) or the general formula (II) as set forth below are preferably used in the invention.

The fogging agent for use in the present invention may be represented by general formula (I)

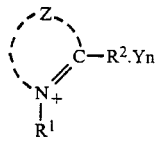

(I)

wherein Z represents a non-metallic atomic group necessary to form a 5-membered or 6-membered heterocyclic ring which may be substituted by a substituent group; $R^1$ repesents an aliphatic group, $R^2$ represents a hydrogen atom, an aliphatic or aromatic group, and $R^1$ and $R^2$ each may be substituted by a substituent group, on condition that at least one of groups represented by $R^1$, $R^2$, and Z contains an alkynyl group, an acyl group, a hydrazine group, or a hydrazone group, or $R^1$ and $R^2$ form a 6-membered ring to forms a dihydropyridinium skeleton; further, at least one of substituent groups of $R^1$, $R^2$, and Z may have $X^1—L^1)_m$ wherein $X^1$ represents an adsorption enhancing group for silver halide, and $L^1$ represents a divalent linking group; Y represents a counterpart ion for electric charge balance; and n represents 0 or 1 and m represents 0 or 1.

Suitable heterocyclic rings completed by Z are, for example, quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxazolium, and benzoxazolium nuclei. Examples of substituent groups of Z are an alkyl group, an alkenyl group, an aralkyl group, an aryl group, an alkynyl group, an hydroxyl group, an alkoxy group, an aryloxy group, halogen atoms, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group, an imino group, and the like. As the substituent group of Z, if two or more groups are selected, they may be the same or different from each other. Further, the above-mentioned substituent groups may have as a further substituent one of the substituent groups.

Further, as a substituent group of Z, a heterocyclic quaternary ammonium group completed by Z may be formed through an appropriate linking group L. In this case, so-called dimer structure is formed.

Preferred heterocyclic rings completed by Z are quonolinium, benzothiazolium, benzothiazolium, benzimidazolium, pyridinium, acridinium, phenanthridinium, naphthopyridinium, and isoquinolinium nuclei. Quinolinium, benzothiazolium, and naphthopyridinium nuclei are more preferred and the quinolinium nucleus is most preferred.

The aliphatic group of $R^1$ and $R^2$ is an unsubstituted alkyl group of 1 to 18 carbon atoms or a substituted alkyl group having a carbon atom number of 1 to 18 in it alkyl part. The substituent group may be the same as the substituent group of Z above.

The aromatic group represented by $R^2$ contains from 6 to 20 carbon atoms, and as the aromatic group, for example, there may be mentioned a phenyl group, a naphthyl group, and the like. The substituent group can be those mentioned as the substituent group of Z. $R^2$ is preferably an aliphatic group and most preferably, a methyl group or a substituted methyl group.

At least one of the groups represented by $R^1$, $R^2$, and Z has an alkyl group, an acyl group, a hydrazine group, or a hydrazone group, or $R^1$ and $R^2$ forms a 6-membered ring to form a dihydropyridinium skeleton. The above-mentioned groups or 6-membered ring may be substituted by a substituent group as mentioned previously as the substituent group of Z.

Preferably at least one of the substituent groups for a group or a ring represented by $R^1$, $R^2$, and Z is an alkynyl group or an acyl group, or $R^1$ and $R^2$ are combined to form a dihydropyridinium skeleton, and most preferably the substituent groups for a group or a ring represented by $R^1$, $R^2$, and Z includes at least one alkynyl group.

Preferred examples of the adsorption enhancing group for silver halides represented by $X^1$ are thioamide groups, mercapto groups, and 5-membered or 6-membered nitrogen-containing heterocyclic groups.

The heterocyclic group may be substituted by a substituent group taken from the groups listed above as the substituent groups of Z.

The thioamide group is preferably a non-cyclic thioamide group (for example, a thiourethane group, a thioureido group, or the like).

As the mercapto group of $X^1$, a heterocyclic mercapto group (for example, 5-mercaptotetrazole, 3-mercapto-1,2,4-triazole, 2-mercapto-1,3,4-thiadiazole, or the like) is especially preferred.

The 5-membered or 6-membered nitrogen-containing heterocyclic ring represented by $X^1$ is the one comprising the combination of carbon with nitrogen, oxygen, or sulfur. It is preferably one capable of forming imino silver, for example, benzotriazole.

The divalent linking group represented by $L^1$ is an atom or an atomic group containing at least one atom of C, N, S, and O. It preferably comprises a group selected from, for example, an alkylene group, an alkenylene group, an alkynylene group, an arylene group (each of which may have a substituent group), —O—, —S—, —NH—, —N=, —CO—, and —$SO_2$—, or a combination of those groups.

Counterpart ions Y for electric charge balance include, for example, bromine ion, chlorine ion, iodine ion, p-toluenesulfonic acid ion, ethylsulfonic acid ion, perchloric acid ion, trifluoromethanesulfonic acid ion, thiocyanic acid ion, and the like.

These compounds, and the methods of their synthesis, are disclosed in patents cited in *Research Disclosure,* No. 22534 (January, 1983), pages 50–54, and ibid, No. 23213 (August, 1983), pages 267–270, in Japanese Patent Publication Nos. 38164/74, 19452/77, and 47326/77, in Japanese Patent Application (OPI) Nos. 69613/77, 3426/77, 138742/80, and 11837/85 (the term "OPI" as used herein refers to a "published unexamined Japanese patent application"), and in U.S. Pat. Nos. 4,306,016 and 4,471,044.

Specific examples of compounds represented by the general formula (I) will be mentioned hereinafter. However, the invention is not limited to these examples.

I-1

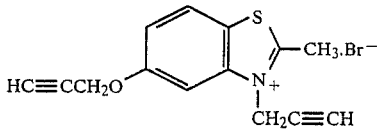

I-2

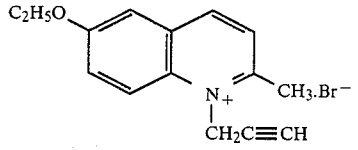

I-3

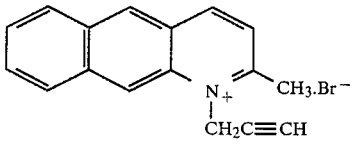

I-4

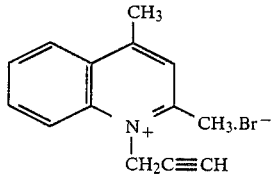

I-5

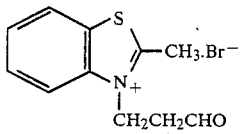

I-6

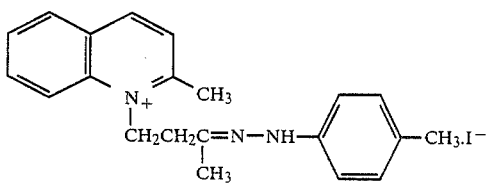

I-7

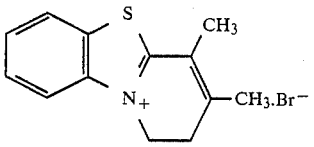

I-8

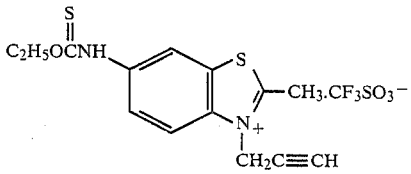

I-9

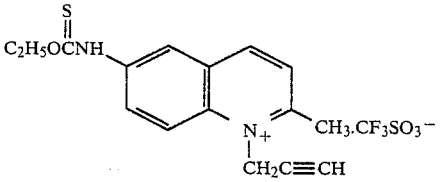

I-10

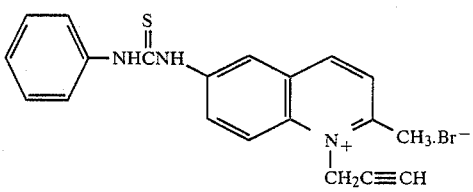

I-11

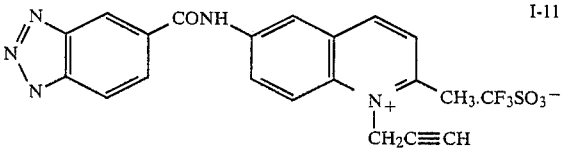

I-12

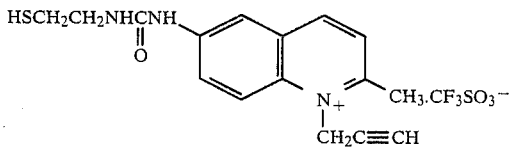

I-13

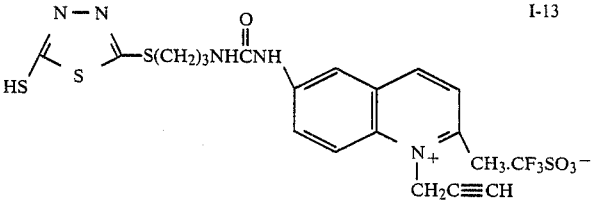

I-14

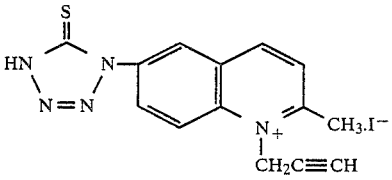

The fogging agent suitable for use in the present invention may also be represented by general formula (II):

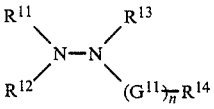

(II)

wherein $R^{11}$, $R^{12}$, and $R^{13}$ each represents a hydrogen atom, an aliphatic group, an aromatic group, an alkylsulfonyl group, an arylsulfonyl group, or an acyl group; $R^{14}$ represents a hydrogen atom, an alkyl group, an aralkyl group, an aryl group, a heterocyclic group, an alkoxy group, an aryloxy group, an amino group, or a carbamoyl group; $G^{11}$ represents a carbonyl group, a sulfonyl group, a sulfoxy group, a phosphoryl group, or an iminomethylene group

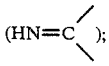

and n represents 0 or 1.

The aliphatic group represented by $R^{11}$, $R^{12}$, or $R^{13}$ is preferably comprised of from 1 to 30 carbon atoms, and is especially preferably a striaght, branched, or cyclic alkyl group of 1 to 20 carbon atoms. The branched alkyl group may be cyclized to form a saturated heterocyclic ring containing one or more hetero-atoms. The alkyl group may also have a substituent group such as an aryl group, an alkoxy group, a sulfoxy group, a sulfonamide group, a carbonamide group, or the like.

Example of aliphatic groups include, for example, a t-butyl group, a n-octyl group, a t-octyl group, a cyclohexyl group, a pyrrolidyl group, an imidazolidyl group, a tetrahydrofuryl group, a morpholino group, and the like.

The aromatic group represented by $R^{11}$, $R^{12}$, or $R^{13}$ in the general formula (II) is a monocyclic or dicyclic aryl or unsaturated heterocyclic group. The unsaturated heterocyclic group herein may be condensed with a monocyclic or dicyclic aryl group to form a heteroaryl group.

The above-mentioned aromatic group includes, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, and the like. Of these, a group containing a benzene ring is preferred, and an aryl group is particularly preferred.

The aryl group or unsaturated heterocyclic group of $R^{11}$, $R^{12}$, and $R^{13}$ may have a substituent group. Typical substituent groups are, for example, an alkyl group, an aralkyl group, an alkoxy group, an amino group substituted with an alkyl or aryl group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, a carboxyl group, and the like.

The alkyl group represented by $R^{14}$ is preferably a straight, branched, or cyclic alkyl group of 1 to 30 carbon atoms. The alkyl group includes specifically a methyl group, an ethyl group, a butyl group, a t-butyl group, a cyclohexyl group, an octyl group, a dodecyl group, an octadecyl group, and the like. The aralkyl group represented by $R^{14}$ is preferably comprises 7 to 30 carbon atoms, and may be, for example, a benzyl group, a phenethyl group, a naphthylmethyl group, and the like. The aryl group represented by $R^{14}$ is preferably comprised of from 6 to 30 carbon atoms, and may be, for example, a phenyl group, a naphthyl group, and the like. The heterocyclic group represented by $R^{14}$ is preferably comprised of from 1 to 12 carbon atoms and may be, for example, an imidazolyl group, a pyridyl group, and the like. The alkoxy group represented by $R^{14}$ is preferably comprised of from 1 to 30 carbon atoms and may be, for example, a methoxy group, an ethoxy group, an octyloxy group, a dodecyloxy group, a benzyloxy group, a cyclohexyloxy group, and the like. The aryloxy group represented by $R^{14}$ is preferably comprised of from 6 to 30 carbon atoms and may be, for example, a phenoxy group, naphthyloxy group, and the like. An amino group represented by $R^{14}$ preferably contains from 0 to 30 carbon atoms, and it includes, for example, an unsubstituted amino group, a methylamino group, a phenylamino group, and the like. The carbamoyl group represented by $R^{14}$ is preferably comprised of from 1 to 30 carbon atoms and may be, for example, a carbamoyl group, a N,N-diethylcarbamoyl group, a phenylcarbamoyl group, and the like.

Alkyl groups, aralkyl groups, aryl groups, heterocyclic groups, alkoxy groups, aryloxy groups, amino groups, and carbamoyl groups represented by $R^{14}$ may have a substituent group, and suitable substituent groups are the same groups as mentioned above as the substituent group of $R^{11}$, $R^{12}$, and $R^{13}$.

Further, of the compounds represented by the general formula (II), those represented by a general formula (III) as set forth below are preferred:

$$R^{21}-\underset{\underset{R^{22}}{|}}{N}-\underset{\underset{R^{23}}{|}}{N}-G^{21}-R^{24} \qquad \text{(III)}$$

wherein $R^{21}$ represents an aliphatic group or an aromatic group; $R^{24}$ represents a hydrogen atom, an alkyl group, an aralkyl group, an aryl group, an alkoxy group, an aryloxy group, or an amino group; $G^{21}$ represents a carbonyl group, a sulfonyl group, a sulfoxy group, a phosphoryl group or an iminomethylene group $$(HN{=}C\ ); \qquad (\text{with the C bonded to two adjacent groups})$$

and $R^{22}$ and $R^{23}$ each represents a hydrogen atom, or one of $R^{22}$ and $R^{23}$ represents a hydrogen atom and the other of them represents an alkylsulfonyl group, an arylsulfonyl group, or an acyl group or $G^{21}$, $R^{22}$, $R^{23}$, and a hydrazine nitrogen may form a hydrazone structure $$(\ N{-}N{=}C\ ). \qquad (\text{with the C bonded to two adjacent groups})$$

The groups mentioned above may be substituted by a substituent group.

Substituent groups of $R^{21}$ are the same substituent groups as for $R^{11}$, $R^{12}$, $R^{13}$, and $R^{14}$ in the above-mentioned general formula (II), and as the substituent groups of $R^2$, ureido group are particularly preferred.

The above-mentioned substituent groups may be combined with each other to form a ring.

Preferred groups as $R^{21}$ are an aromatic group and an aromatic heterocyclic- or aryl-substituted methyl group, with aryl groups (such as phenyl group, naphthyl group, and the like) being more preferred.

Preferred substituents represented by $R^{24}$ include a hydrogen atom, alkyl groups (for example, a methyl group), an aralkyl groups (for example, a hydroxybenzyl group), and the like, with a hydrogen atom being particularly preferred.

$R^{24}$ may be further substituted, and the substituent group may be selected from those listed as the substituent group of the above-mentioned $R^{11}$, $R^{12}$, $R^{13}$, and $R^{14}$ and may further include, for example, acyl groups, acyloxy groups, alkyl- or aryloxycarbonyl groups, alkenyl groups, alkynyl groups, and a nitro group.

These substituent groups may be further substituted by the above described substituent group, or may be combined with each other to form a ring.

$R^{21}$ and $R^{24}$ each may be or, more preferably, $R^{21}$ may be a group having a ballast group incorporated into it which ballast group is used practically in an immovable photographic additive such as a coupler or the like. A ballast group is a group relatively inactive to photographic properties which has 8 or more carbon atoms and it can be selected from alkyl groups, alkoxy groups a phenyl group, alkylphenyl groups, a phenoxy group, a alkylphenoxy groups, and the like.

$R^{21}$ and $R^{24}$ each may be a group containing a group which strengthens adsorption of it on the surface of silver halide grains. Suitable adsorptive groups are groups such as thiourea groups, heterocyclic thioamide groups, mercapto heterocyclic groups, triazole groups, and the like which are disclosed in U.S. Pat. Nos. 4,385,108 and 4,459,347, in Japanese Patent Application (OPI) Nos. 195233/84, 200231/84, 201045/84, 201046/84, 201047/84, 201048/84, 201049/84, 179734/85, and 170733/86, and in Japanese Patent Application No. 19739/84 (corresponding to U.S. Ser. No. 826,153).

Preferred adsorptive groups are non-cyclic thioamide groups (for example, thioureido group, thiourethane group, and the like), cyclic thioamide groups (that is, mercapto-substituted, nitrogen-containing heterocyclic rings, for example, a 2-mercaptothiazole group, a 3-mercapto-1,2,4-triazole group, a 5-mercaptotetrazole group, a 2-mercapto-1,3,4-oxadiazole group, a 2-mercaptobenzoxazole, and the like), and nitrogen-containing heterocyclic groups (for example, benzotriazole group, benzimidazole group, imidazole group, and the like).

Substituent groups of $R^{22}$ and $R^{23}$ are alkyl sulfonyl groups of 20 or less carbon atoms, aryl sulfonyl groups of 20 or less carbon atoms (preferably a phenyl sulfonyl group or phenyl sulfonyl groups substituted so that the sum of Hamett's substituent constants is −0.5 and over), acyl groups of 20 or less carbon atoms (preferably, a benzoyl group or benzoyl groups substituted so that the sum of Hammett's substituent constants is −0.5 and over), and straight, branched, or cyclic, unsubstituted or substituted aliphatic acyl groups (which, if further substituted, have a halogen atom, an ether group, a sulfonamide group, a carbonamide group, a hydroxyl group, a carboxy group, a sulfonic group, or the like as a substituent group).

Groups represented by $-G^{21}-R^{24}$ include specifically a formyl group, acyl groups (such as an acetyl group, a propionyl group, a trifluoroacetyl group, a chloroacetyl group, a benzoyl group, a 4-chlorobenzoyl group, a pyruvoyl group, a methoxalyl group, a methyloxamoyl group, and the like), alkyl sulfonyl groups (such as a methane sulfonyl group, a 2-chloroethane sulfonyl group, and the like), aryl sulfonyl groups (such as a benzene sulfonyl group, and the like), alkyl sulfinyl groups (such as a methane sulfinyl group, and the like), aryl sulfinyl groups (such as a benzene sulfinyl group, and the like), carbamoyl groups (such as a methylcarbamoyl group, a phenylcarbamoyl group, and the like), sulfamoyl groups (such as a dimethylsulfamoyl group, and the like), alkoxycarbonyl groups (such as a methoxycarbonyl group, a methoxyethoxycarbonyl group, and the like), aryloxycarbonyl groups (such as a phenoxycarbonyl group, and the like), sulfinamoyl groups (such as a methylsulfinamoyl group, and the like), alkoxy sulfonyl groups (such as a methoxy sulfonyl group, an ethoxy sulfonyl group, and the like), thioacyl groups (such as a methylthiocarbonyl group, and the like), thiocarbamoyl groups (such as a methylthiocarbamoyl group, and the like), and heterocyclic groups (such as pyridine ring, and the like). Of these, formyl groups and acyl groups are specially preferred.

A hydrazone structure

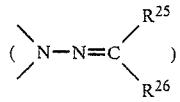

may be formed by $G^{21}$, $R^{22}$, $R^{23}$, and a hydrazine nitrogen in the general formula (III).

In the above-mentioned structure, $R^{25}$ represents an alkyl group, an aryl group, or a heterocyclic group, and $R^{26}$ represents a hydrogen atom, an alkyl group, an aryl group, or a heterocyclic group.

Examples of hydrazine-containing nucleating agents having an adsorptive group for silver halide, and methods for their synthesis, are disclosed, for example, in U.S. Pat. Nos. 4,030,925, 4,080,207, 4,031,127, 3,718,470, 4,269,929, 4,276,364, 4,278,748, 4,385,108, 4,459,347, 4,478,928, and 4,560,632, in British Patent No. 2,011,391B, and in Japanese Patent Application (OPI) Nos. 74729/79, 163533/80, 74536/80, and 179734/85.

Other hydrazine-containing nucleating agents are disclosed, for example, in Japanese Patent Application (OPI) No. 86829/82, and in U.S. Pat. Nos. 4,560,638, 4,478,928, 2,563,785, and 2,588,982.

Specific examples of compounds represented by the general formula (II) will be shown hereinafter. However, the invention is not limited to the compounds shown below:

$R_{11}$-NHNHCHO (wherein $R_{11}$ is specifically shown in Table A below)

TABLE A

| | $R_{11}$ |
|---|---|
| II-1 | 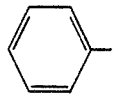 |
| II-2 | 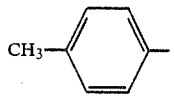 |
| II-3 | 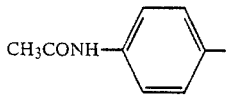 |

TABLE A-continued
| | $R_{11}$ |
|---|---|
| II-4 | 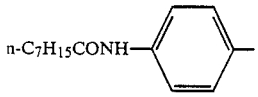 |
| II-5 | 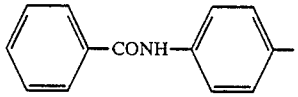 |
| II-6 | 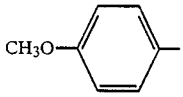 |
| II-7 | 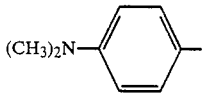 |
| II-8 | 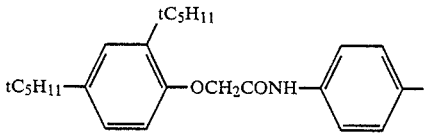 |
| II-9 | 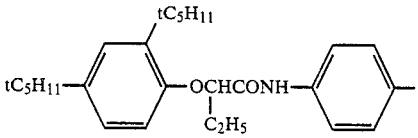 |
| II-10 | 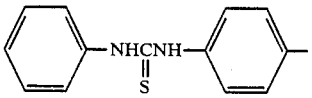 |
| II-11 | 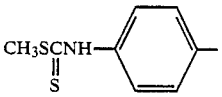 |
| II-12 | 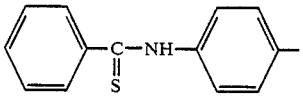 |
| II-13 | 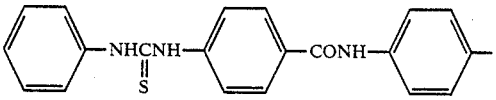 |
| II-14 | 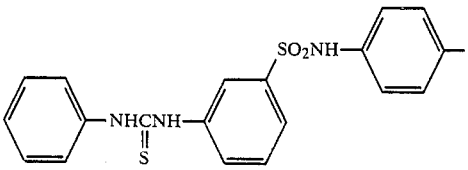 |

TABLE A-continued
| | $R_{11}$ |
|---|---|
| II-15 | 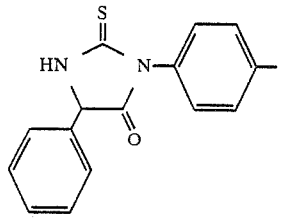 |
| II-16 | 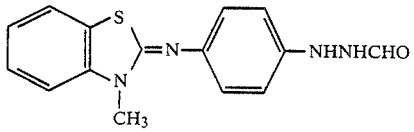 |
| II-17 | 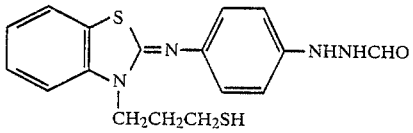 |
| II-18 | 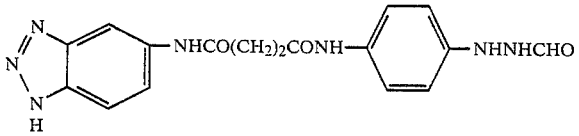 |
| II-19 | 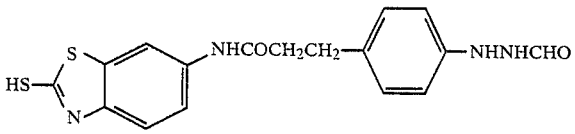 |
| II-20 | 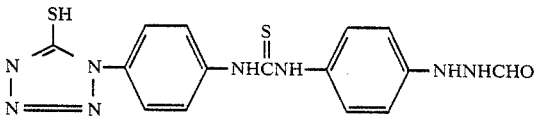 |
| II-21 | 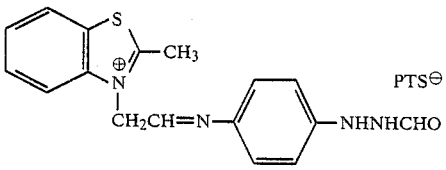 |
| II-22 | 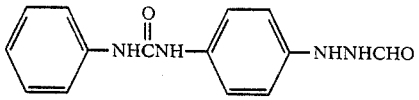 |
| II-23 | 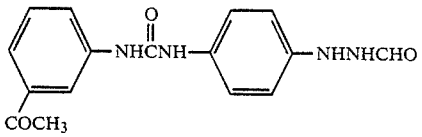 |
| II-24 | 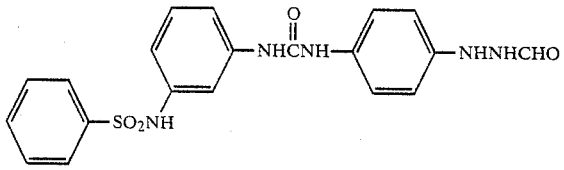 |

TABLE A-continued
| | $R_{11}$ |
|---|---|
| II-25 | 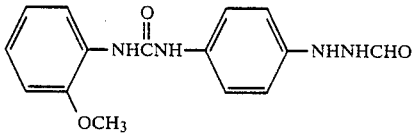 |
| II-26 | 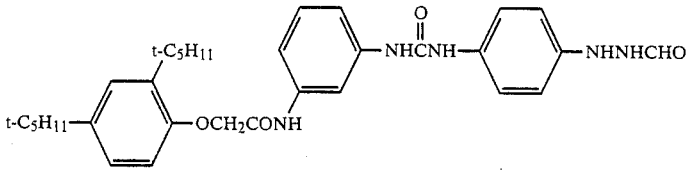 |
| II-27 | 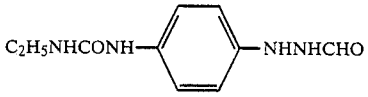 |
| II-28 | 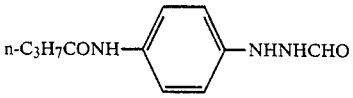 |
| II-29 | 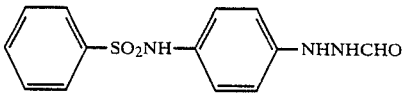 |
| II-30 | 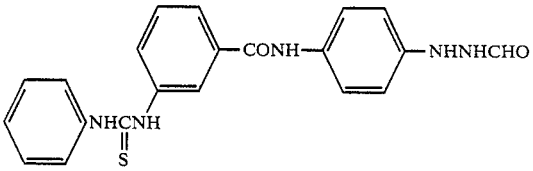 |
| II-31 | 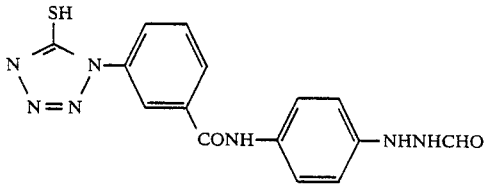 |
| II-32 | 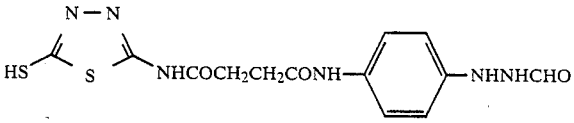 |
| II-33 | 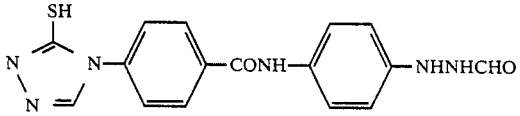 |
| II-34 | 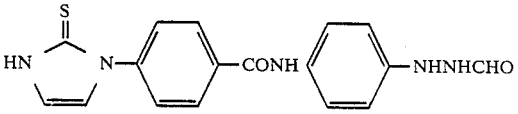 |

TABLE A-continued
| | $R_{11}$ |
|---|---|
| II-35 | 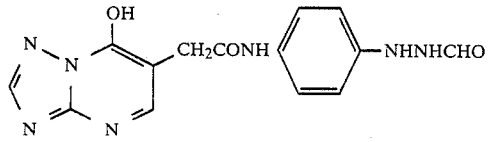 |
| II-36 | 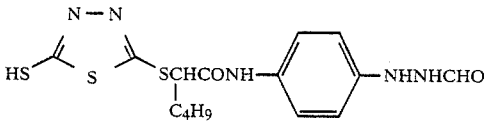 |
| II-37 | 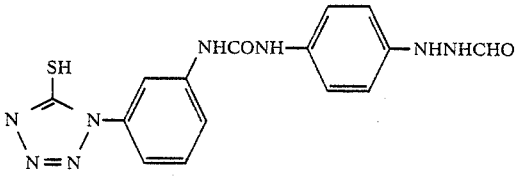 |
| II-38 | 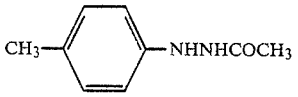 |
| II-39 | 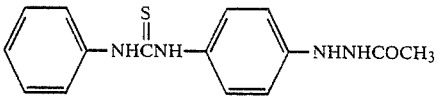 |
| II-40 | 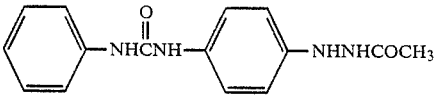 |
| II-41 | 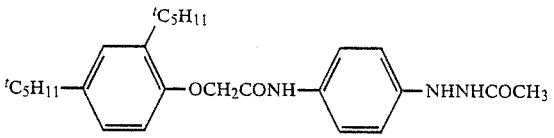 |
| II-42 | 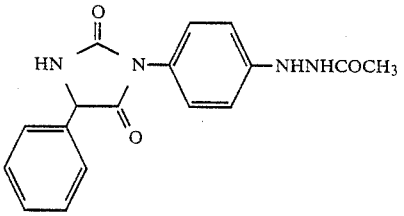 |
| II-43 | 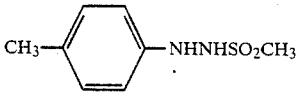 |
| II-44 | 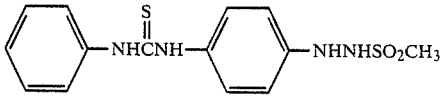 |
| II-45 | 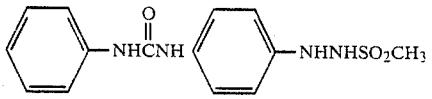 |

TABLE A-continued
| | $R_{11}$ |
|---|---|
| II-46 | 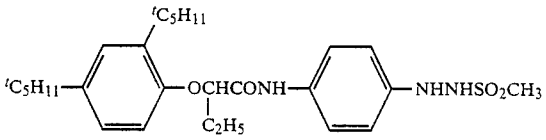 |
| II-47 | 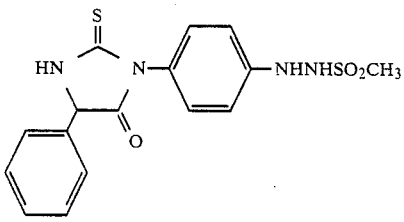 |
| II-48 | 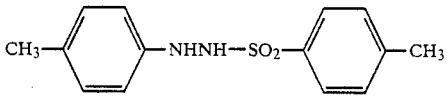 |
| II-49 | 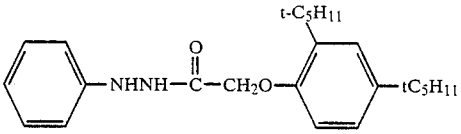 |
| II-50 | 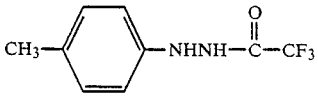 |
| II-51 | 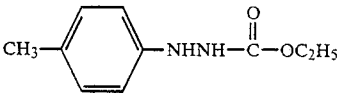 |
| II-52 | 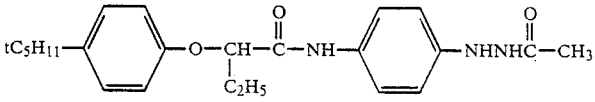 |
| II-53 | 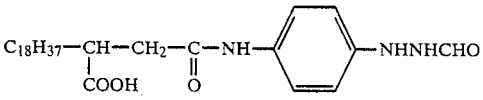 |
| II-54 | 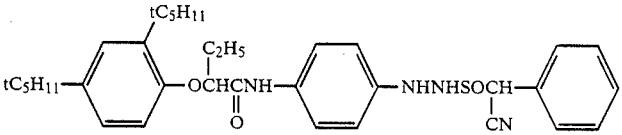 |
| II-55 | 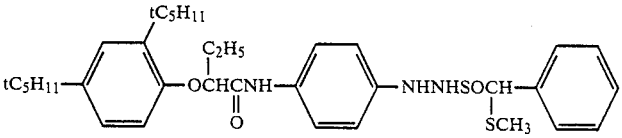 |
| II-56 | 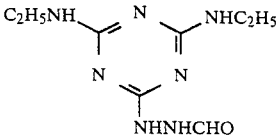 |

TABLE A-continued
| | $R_{11}$ |
|---|---|
| II-57 | 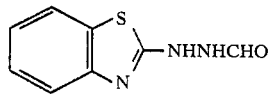 |
| II-58 | 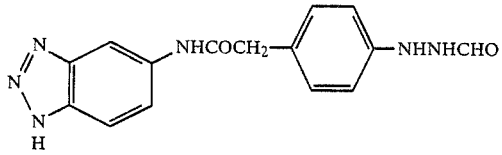 |
| II-59 | $n\text{-}C_{12}H_{25}$—NHNHCHO |
| II-60 | 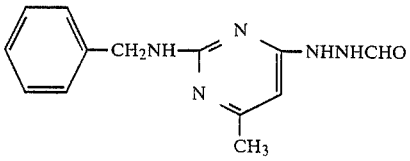 |
| II-61 | 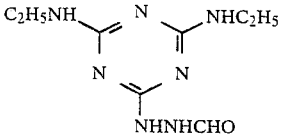 |
| II-62 | 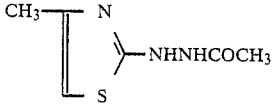 |
| II-63 | 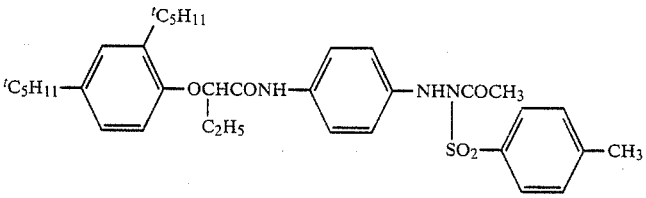 |
| II-64 | 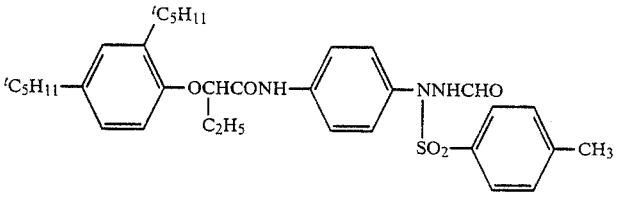 |
| II-65 | 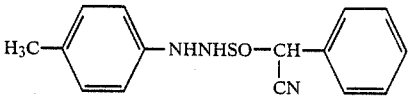 |
| II-66 | 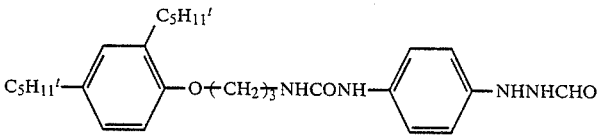 |
| II-67 | 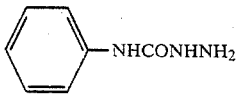 |
| II-68 | $H_2NCONHNH_2$ |

TABLE A-continued
| | $R_{11}$ |
|---|---|
| II-69 | $H_2NNH(CH_2)_4SO_3H$ |
| II-70 | $H_2NNH(CH_2)_2OH$ |
| II-71 | $H_2NNHCOCH_3$ |
| II-72 | $H_2NNHCOOC_2H_5$ |
| II-73 | 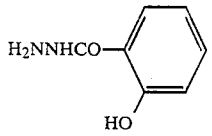 |
| II-74 | 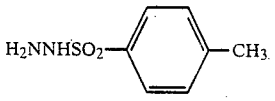 |
| II-75 | 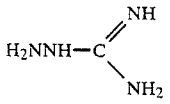 |
| II-76 | $H_2NNHCOCONHNH_2$ |
| II-77 | 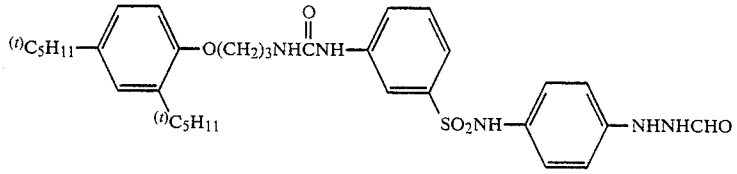 |
| II-78 | 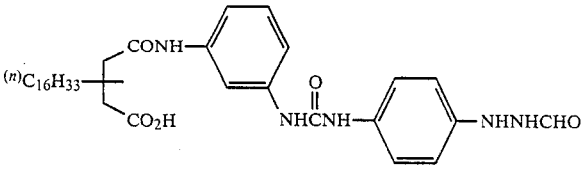 |
| II-79 | 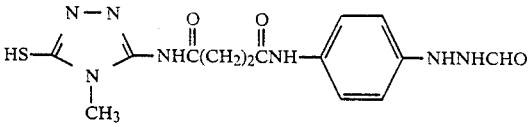 |
| II-80 | 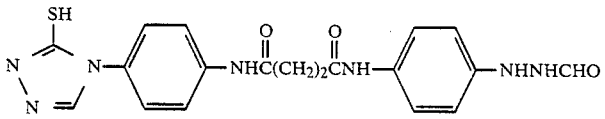 |
| II-81 | 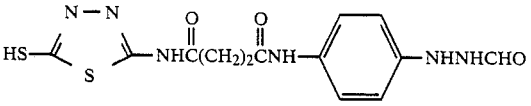 |
| II-82 | 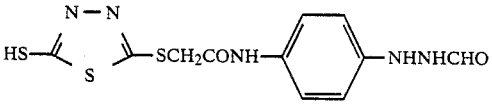 |
| II-83 | 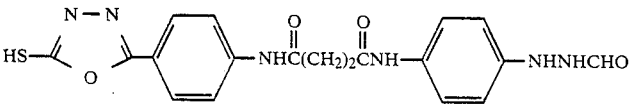 |

TABLE A-continued

| | $R_{11}$ |
|---|---|
| II-84 | 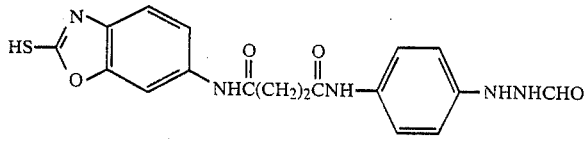 |
| II-85 | 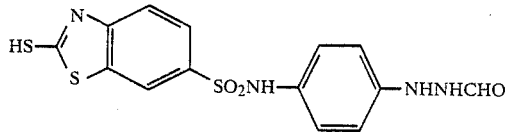 |
| II-86 | 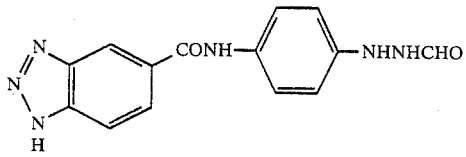 |
| II-87 | 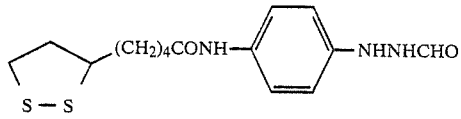 |
| II-88 | 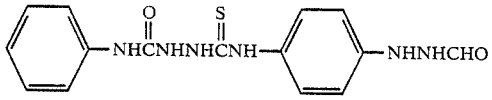 |
| I-89 | 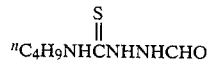 |
| II-90 | 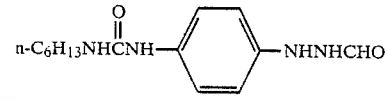 |

A photosensitive element for diffusion transfer of silver salts which photosensitive element has a photosensitive silver halide emulsion layer on a substrate is preferably used in the invention.

As the silver halide grains, grains forming a latent image mainly on the surface when exposed are used. An embodiment comprising exposing a so-called negative type silver halide emulsion containing such silver halide grains, treating the emulsion with an alkaline treatment composition containing an uracil-containing solvent for silver halides in the presence of a hydroxylamine-containing developing agent, and diffusion transferring a transferable silver complex salt to an image receiving layer to obtain a silver image on the layer is, in particular, preferred in the invention.

As a silver halide for a photosensitive silver halide emulsion used in the invention, any of silver bromide, silver iodobromide, silver iodochlorobromide, silver chlorobromide, and silver chloride can be used. Of these, silver iodobromide or silver iodochlorobromide containing 10 mol% or less of silver iodide is preferred, and silver iodobromide containing 3 to 10 mol% of silver iodide is especially preferred.

The average grain size of the silver halide grains in a photosensitive emulsion (which is expressed by an average based on the projected area taking a grain diameter when particles are spherical or approximately spherical, or an edge length when particles are cubic as an grain size) is not specially limitative. However, the average grain size is preferably 3 microns or less, further preferably 1.5 micons or less, and especially preferably 0.4 to 1.2 microns.

The grain size distribution may be sharp or broad.

Silver halide grains in the photosensitive emulsion may have a crystalline form isometric system such as a cube, an octahedron, or the like, an irregular crystalline form such as a spherical crystalline form, a tabular crystalline form, or the like, or a composite form of these crystalline forms. The photosensitive silver halide emulsion layer may comprise a mixture of grains having various crystalline forms.

Silver halide grains may be composed of phases different from each other in the inside and in the surface layer or may be composed of a uniform phase. Further, they may be grains having a latent image formed mainly on the surface when exposed or grains having a latent image formed mainly in the inside when exposed. However, the former grains are preferred.

The thickness of the photosensitive emulsion layer is preferably from 0.5 to 8.0 microns, more preferably 0.6 to 6.0 microns, and the coating weight of silver halide grains is preferably from 0.1 to 3 g/m$^2$, more preferably 0.2 to 1.5 g/m$^2$.

The photosensitive emulsion is prepared by a method usually used for a silver halide photographic emulsion, and chemical sensitization and spectral sensitization are applied to it, as required. Further, an antifoggant, a stabilizer, a hardening agent, a coating assistant, an antistatic agent, and the like can be contained in the photosensitive emulsion. A vehicle such as gelatin or the like may be used in the emulsion.

As an example of a method to form an image in the invention, a developing agent can be provided in the photosensitive element or containined in the processing composition, and it is preferably contained in the processing composition. As the developing agent, a benzene- or naphthalene-containing organic compound such as hydroquinone, t-butylhydroquinone, p-aminophenol, or the like which has a hydroxyl group and/or an amino group at the para or ortho position may be used.

Further, reductinic acid as mentiond in U.S. Pat. No. 3,615,440 and $\alpha,\beta$-endiole as mentioned in U.S. Pat. No. 3,730,716 are preferably used. Further, a hydroxylamine developing agent as mentioned in U.S. Pat. Nos. 3,287,125 and 3,293,034 is used especially preferably.

An amount of developing agent used is preferably 0.1 to 40 g per 100 g of processing composition, and most preferably 1 to 20 g per 100 g of processing composition.

A solvent for silver halides such as uracil, a thiosulfate or the like can be contained in the processing composition, the photosensitive element and/or the image receiving element. It is most preferred that it is contained in the processing composition. As the solvent, cyclic compounds as mentioned in U.S. Pat. Nos. 2,857,274, 2,857,275, and 2,857,276 are most suitable, and of those, uracil, urasole, 6-methyluracil, and the like are preferred examples.

Further, the solvent can be selected from disulfonylmethane compounds mentioned in U.S. Pat. Nos. 3,958,992, 3,976,647, 4,009,167, 4,032,538, 4,046,568, 4,047,954, 4,047,955, and 4,107,176, and in Japanese Patent Application (OPI) No. 330/72; dihydroxypyrimidine compounds having a thioether group mentioned in U.S. Pat. Nos. 4,126,459, 4,150,228, 4,211,559 and 4,211,562; and aminothioethers mentioned in U.S. Pat. Nos. 4,251,617, 4,267,254, and 4,267,256.

These solvents can be used in the form of a single compound or of a combination of a plurality of compounds.

The amount of the solvent for silver halides which is added is preferably 1.0 to 30 g per 100 g of alkaline processing composition and most preferably 2.0 to 10 g based on the same basis.

The processing composition may further contain other publicly-known assistants in a silver halide diffusion transferring method, for example, antifoggants, toning agents, stabilizers, and the like. In particular, it is useful for increasing the storage life of a processing composition solution that, as mentioned in U.S. Pat. No. 3,619,185, an oxyethylamino compound, for example, triethanolamine, is contained in the processing composition.

The processing composition as mentioned above is preferably in a rupturable container to provide a processing element. As the rupturable container design and material, any publicly-known rupturable container design and material can be used. Containers and materials are disclosed in detail, for example, in U.S. Pat. Nos. 3,056,491, 3,056,492, 3,173,580, 3,750,907, 3,833,381, 4,303,750, and 4,303,751.

The image receiving element used in the invention has a substrate supporting an image receiving layer containing a precipitant for silver which substrate comprises, for example, baryta paper, resin-laminated paper, cellulose triacetate, polyesters, or the like. Such an image receiving element can be preferably prepared by coating a substrate which has been undercoated, as required, with a coating solution of an appropriate cellulose, for example, cellulose diacetate, which coating solution has a precipitant for silver dispersed in it. The thus obtained cellulose ester layer is hydrolyzed with an alkali to change the cellulose ester to cellulose at least partially in the depth direction. In an especially useful specific example, the cellulose ester in the layer of precipitant for silver and/or in a lower layer not subjected to hydrolysis, for example, a non-hydrolyzed portion of a cellulose ester layer containing cellulose diacetate, contains one or more types of mercapto compounds suitable for improvement of color tone, stability, or other photographic properties of the transferred silver image. During the imbibition, such mercapto compounds are diffused from a layer where they have been positioned initially to a layer where they are utilized. An image receiving element of this type is disclosed in U.S. Pat. No. 3,607,269.

It is preferred that an image stabilizing layer for improving storage properties of images is contained in an image receiving element. As the stabilizer, cationic high molecular weight electrolytes are preferred and, in particular, water-dispersed latexes mentioned in Japanese Patent Application (OPI) Nos. 166940/84, 142339/80, 126027/79, 155835/79, 30328/78, and 92274/79 and in U.S. Pat. No. 3,958,995, polyvinylpylidinium salts mentioned in U.S. Pat. Nos. 2,548,564, 3,148,061, and 3,756,814, water-soluble quaternary ammonium salt polymers mentioned in U.S. Pat. No. 3,709,690, and water-insoluble quaternary ammonium salt polymers mentioned in U.S. Pat. No. 3,898,088 are preferred.

Cellulose acetate is preferred as a binder for the image-stabilizing layer, and in particular, cellulose acetate having an acetylation degree of 40 to 49% is preferred.

Further, it is preferred to dispose an intermediate layer between an image receiving layer and a layer containing a toning agent or a stabilizer. Preferred intermediate layers, are gum arabic, polyvinyl alcohol, polyacrylamide, and the like.

Specific examples of precipitants for silver are heavy metals, for example, iron, lead, zinc, nickel, cadmium, tin, chromium, copper, and cobalt, and, in particular, noble metals, for example, gold, silver, platinum, and palladium. Other useful precipitants for silver are sulfides are selenides of heavy metals, in particular, sulfides of mercury, copper, aluminum, zinc, cadmium, cobalt, nickel, silver, lead, antimony, bismuth, cerium, magnesium, gold, platinum, and palladium and selenides of lead, zinc, antimony, and nickel.

In particular, platinum, palladium, and sulfides thereof are preferred.

Regading the pH value at which the silver image is formed, it is preferred to maintain the pH value at a level of 12 to 14 until the silver image is formed, provided that the pH value is maintained at a level of 13 to 14 if a developing agent is a hydroxylamine-containing compound, and it is preferred to reduce the pH value to a level of 4 to 9 after the silver image is formed.

With aim of a reduction of pH value or the like, a layer (a neutralizing layer or a timing layer) containing an acid polymer such as a maleic acid copolymer and/or an acrylic acid copolymer is preferably disposed in an image receiving element.

It is preferred to dispose a release layer on the surface of the image receiving layer to prevent the processing solution from sticking to the surface of image receiving layer when the image receiving layer is released from the photosensitive layer after development with the processing solution. As preferred materials used as such a released layer, there may be mentioned gum arabic, hydroxyethyl cellulose, methyl cellulose, polyvinyl alcohol, polyacrylamide, and sodium alginate, and further, materials mentioned in U.S. Pat. Nos. 3,772,024 and 3,820,999 and in British Pat. No. 1,360,653.

A brightening agent can also be added to an image receiving layer to improve the whiteness and it is also useful to add a plasticizer to soften a polymer layer applied.

In a special embodiment of the invention, it is possible to incorporate an image receiving layer into a photosensitive element as mentioned below. As a preferred example of the embodiment, on a transparent polyethylene terephthalate sheet, an image receiving layer containing a precipitant for silver, a light reflecting layer containing white pigments such as titanium oxide, a light shielding layer containing a light absorbing material such as carbon black, and a photosensitive silver halide emulsion layer are disposed in order. In addition, in the case of a mono sheet type, the light shielding layer is adjacent to the silver halide emulsion layer. On the other hand, the light shielding layer may be provided on the side opposite the silver halide emulsion layer. In such an embodiment, even if the photosensitive emulsion layer is not released after the exposed emulsion layer is diffusion transfer-treated, an image formed on the image receiving layer can be observed through the transparent polyethylene terephthalate sheet because the back layer is shielded by the lgiht reflecting layer.

Exposure to obtain a photographic image may be carried out by a usual method. Any one of many publicly-known light sources such as natural light (sunlight), tungsten lamps, fluorescent lamps, mercury lamps, xenon arc lamps, carbon arc lamps, xenon flash lamps, cathode ray tube flying spots, and the like can be used. Exposure time is dependent on intensity of exposure, and may be a time of 1/1000 second to 1 second for a usual camera, an exposure time shorter than 1/1000 second, for examle, a time of $1/10^4$ to $1/10^6$ second using a xenon flash lamp or a cathode ray tube, and also may be longer than 1 second. The spectral composition of light used for exposure can be controlled with a color filter, as required. Laser light can be used for exposure. Exposure may also be carried out with light emitted from a luminescent material excited by electron beams, x-rays, $\gamma$-rays, $\alpha$-rays, or the like.

A film unit may be prepared by combining a photosensitive element, an image receiving element, and a processing element each described above. Arrangement of the elements and a method to connect them are mentioned, for example, in Neblettes, *Handbook of Photography and Reprography*, 7th edition, pages 282–285, and an especially preferred embodiment of a film unit is described in detail in U.S. Pat. No. 3,350,991, and these references are hereby incorporated by reference.

The invention contemplates not only a release type film unit whose image receiving element and photosensitive element are released from each other after development with a processing composition, but also to an integral molded type film unit.

In a method to form an image for diffusion transfer of silver salts, in particular, in a method to form an image by using a negative type silver halide emulsion and treating the exposed negative type silver halide emulsion in the presence of a hydroxylamine-containing developing agent, a silver image whose maximum density is not reduced even if a developing time is prolonged and whose gradation in a high density part does not become hard under the same condition as the above can be obtained by a treatment in the presence of a fogging agent. Further, a method to form an image substantially free from formation of silver mirror has been found by a treatment in the presence of a fogging agent. As the fogging agent, those without adsorptivity and hardly diffusable are preferred, and, of compounds represented by the general formula (II), those without adsorptivity and hardly diffusable are particularly suitable for obtaining the above-mentioned effects.

EXAMPLES

The invention will be described referring to examples hereinafter. However, the invention is not limited to these examples. All figures hereafter expressed as percentage will refer to percent by weight, unless otherwise specified.

EXAMPLE 1

Photosensitive silver halide emulsion-1

Silver halide grains were formed by a double jet process, were physically ripened by usual method, desalted, then chemically ripened, dispersed in a vehicle, and thus a silver iodobromide emulsion (having an iodine content of 6.5 mol%) was obtained. Silver halide grains in the emulsion had an average grain diameter of 0.7 $\mu$m.

Preparing photosensitive sheets 1 through 17

The above-mentioned emulsion-1 was dissolved in water at 40° C. To each 1 kg of the solution (containing 0.65 mol of silver halide), 200 ml of a 0.02 wt% methanol solution of 3-{5-chloro-2-[2-ethyl-3-(3-ethyl-2-benzothiazolinylidene)propenyl]-3-benzoxazolio}propane sulfonate; 200 ml of 0.02 wt% methanol solution of 4-{2-[(3-ethylbenzothiazoline-2-ylidene)-2-methyl-1-propenyl]-3-benzothiazolio}butane sulfonate; 100 ml of 1 wt% aqueous solution of 4-hydroxy-6-methyl-1,3,3a,7-tetrazaindene; 10 ml of a 1 wt% methanol solution of lipoc acid; 40 ml of a 4 wt% aqueous solution of 2-hydroxy-1,3-bisvinylsulfonylpropane; and gelatin were added. To the solution, fogging agent I-2 of the invention was added.

The above-mentioned solution was applied to a substrate to prepare a photosensitive layer sheet. A protective layer comprising gelatin was applied at the same time the above-mentioned solution was applied. The substrate was an undercoated white polyethylene terephthalate film coated with a carbon black layer for light shielding on its side opposite to a silver halide emulsion layer side.

Sheets 2 through 17 were prepared in the same manner as Sheet 1, except that the fogging agents shown in Table 1 in the amounts shown on Table 1 were employed in place of compound I-2. Each Sheet was cut into two samples.

Image receiving sheet

A solution prepared by dissolving 18 g of cellulose acetate (having an acetylation degree of 54%) and 12 g of a styrene-maleic anhydride copolymer or of an acrylic acidalkyl acrylate copolymer in a mixture of 270 ml of acetone with 30 ml of methanol was applied to polyethylene-laminated paper at a coating thickness of 54 ml/m$^2$ and then dried. To the paper, further 0.05 g/m$^2$ of 3,6-diphenyl-1,4-dimercapto-3H,6H-2,3a,5,6a-tetrazapentallene was applied and a 10% solution of cellulose acetate in acetone was further applied at a coating weight of 10 g/m$^2$. To a 5% aqueous solution of polyacrylamide, a 5% aqueous solution of dimethylolurea and acetic aciad (50%) were added in amounts of 5 wt% and of 1.25 wt% based on the volume of polyacrylamide solution, respectively. The thus prepared solution was further applied at a coating thickness of 25 ml/m$^2$. Further, a 3% solution of cellulose acetate in an acetone/methanol mixture (at a ratio of 9/1 by vol.), which solution had palladium sulfide finely dispersed in it, was applied. 1-Phenyl-5-mercaptoimidazole had been contained in the above-mentioned coating solution to provide a coating weight of $1.25\times 109^{-6}$ mol/m$^2$ of the compound. The thus obtained dry coating film had a thickness of 0.8 μm. To the coated sheet, an alkaline solution as set forth below was applied at a ratio of 18 ml/m$^2$ and then the coated sheet was washed with water and dried. Thus, an image receiving sheet was prepared. The above-mentioned palladium sulfide dispersion was prepared by adding a methanol solution containing $7\times 10^{-3}$ mol of sodium sulfide and a methanol solution containing $7\times 10^{-3}$ mol of palladium chloride sodium to a 5.3% acetone/methanol mixture (at a ratio of 9/1 by vol.) solution of cellulose acetate and then stirring the resulting mixture sufficiently.

| Processing Solution | |
|---|---|
| Potassium hydroxide (85%) | 260 g |
| Titanium dioxide | 3 g |
| Hydroxyethyl cellulose | 70 g |
| Zinc oxide | 10 g |
| N,N—bismethoxyethylhydroxylamine | 50 g |
| Triethanolamine | 7 g |
| Tetrahydropyrimidine thione | 0.4 g |
| 2,4-Dimercaptopyrimidine | 0.35 g |
| 6-n-propylthiouracil | 0.35 g |

To the above-mentioned, water was added to obtain a total weight of 2 kg.

Forming an image

The thus prepared photosensitive layer samples were exposed and superposed on an image receiving layer sheet prepared by a method as set forth above, and then, a processing composition as shown above was infused to a thickness of 0.4 micon between the two sheets to cause diffusion transfer and development of silver complex salts of the photosensitive layer. After 30 seconds, a first sample sheet, and after 5 minutes, the second sheets were released from the image receiving sheet. Thus, a positive image was obtained.

Each positive image sample obtained by the above-mentioned diffusion transfer treatment was measured for a reflection density by use of a TCD type automaic densitometer (a product of Fuji Photo Film Co., Ltd.) to determine the maximum density. The results are shown on Table 1.

TABLE 1

| No. | Fogging Agent | Amount Added* | Maximum Density Release time 30 sec. | Maximum Density Release time 5 min. |
|---|---|---|---|---|
| 1 | I - 2 | $1.2\times 10^{-5}$ | 1.95 | 1.95 |
| 2 | I - 4 | " | 1.96 | 1.97 |
| 3 | I - 6 | " | 1.94 | 1.94 |
| 4 | I - 9 | " | 1.95 | 1.95 |
| 5 | I - 11 | " | 1.97 | 1.96 |
| 6 | I - 13 | " | 1.95 | 1.96 |
| 7 | II - 66 | $1.2\times 10^{-4}$ | 1.94 | 1.94 |
| 8 | II - 77 | " | 1.93 | 1.94 |
| 9 | II - 25 | $5.6\times 10^{-4}$ | 1.92 | 1.93 |
| 10 | II - 31 | $1.2\times 10^{-5}$ | 1.95 | 1.95 |
| 11 | II - 37 | " | 1.96 | 1.96 |
| 12 | II - 86 | " | 1.95 | 1.96 |
| 13 | II - 10 | " | 1.95 | 1.95 |
| 14 | II - 13 | " | 1.95 | 1.95 |
| 15 | II - 9 | " | 1.95 | 1.95 |
| 16 | II - 90 | $1.2\times 10^{-4}$ | 1.95 | 1.96 |
| 17 | None | — | 1.92 | 1.80 |

*Amount added in mol/mol of Ag

Sample Nos. 1 to 16 containing a fogging agent according to the invention had a high maximum density at a release time of 5 minutes as compared with Sample No. 17 containing no fogging agent. It can be seen from Table 1 that the image maximum density was not reduced even if the development time was prolonged.

EXAMPLE 2

A photosensitive sheet identical to Sample No. 17 in Example 1 was used and a plurality of positive image samples were prepared by the same method as in Example 1 except that the fogging agent of the invention was added, as shown in Table 2, to a processing solution. Each Sample was measured for the maximum image density. The results are shown in Table 2.

TABLE 2

| No. | Fogging Agent | Amount Added* | Maximum Density Release time 30 sec. | Maximum Density Release time 5 min. |
|---|---|---|---|---|
| 18 | I - 1 | $5.1\times 10^{-3}$ | 1.95 | 1.95 |
| 19 | I - 2 | " | 1.94 | 1.96 |
| 20 | I - 9 | $1.7\times 10^{-3}$ | 1.93 | 1.94 |
| 21 | II - 1 | $3.5\times 10^{-3}$ | 1.92 | 1.93 |
| 22 | II - 7 | " | 1.93 | 1.94 |
| 23 | II - 10 | " | 1.94 | 1.94 |
| 24 | II - 25 | " | 1.93 | 1.93 |
| 25 | II - 32 | " | 1.92 | 1.93 |
| 26 | II - 58 | $2.7\times 10^{-3}$ | 1.93 | 1.94 |
| 27 | II - 71 | $4.1\times 10^{-3}$ | 1.92 | 1.93 |
| 28 | II - 90 | " | 1.91 | 1.93 |
| 29 | None | — | 1.92 | 1.80 |

*Amount added: mol/l of processing solution.

The same results as in Example 1 were obtained.

EXAMPLE 3

Sample Nos. 1 to 16 and Sample Nos. 18 to 26 each containing the fogging agent of the invention had excellent sharpness as compared with sample 17 containing none of the fogging agent and with sample 27 containing none of the fogging agent, respectively.

EXAMPLE 4

A plurality of samples of photosensitive emulsion sheet were prepared by the same method as in Example 1 except that an emulsion layer was divided into two layers different in an amount of each of Ag and gelatin as shown in Table 3, and the fogging agent of the invention was added to the first layer as shown in Table 4. These samples were tested by the same method as in Example 1. As a result, the same results as in Example 1 were obtained.

TABLE 3

| | Constitution of two emulsion layers | | |
|---|---|---|---|
| | | Ag | Gelatin |
| 1st layer | Layer near substrate | 0.10 g/m$^2$ | 2.0 g/m$^2$ |
| 2nd layer | Layer distant from substrate | 0.40 g/m$^2$ | 1.8 g/m$^2$ |

TABLE 4

| Fogging Agent | Amount Added* |
|---|---|
| II-1 | $3.6 \times 10^{-4}$ |
| II-4 | $1.8 \times 10^{-4}$ |
| II-7 | $2.0 \times 10^{-4}$ |
| II-8 | $3.5 \times 10^{-4}$ |
| II-9 | $5.1 \times 10^{-4}$ |
| II-18 | $1.5 \times 10^{-4}$ |
| II-22 | $3.5 \times 10^{-4}$ |
| II-25 | $1.9 \times 10^{-4}$ |
| II-46 | $1.8 \times 10^{-4}$ |
| II-56 | $1.9 \times 10^{-4}$ |
| II-63 | $2.0 \times 10^{-4}$ |
| II-66 | $1.8 \times 10^{-4}$ |

*A mol ratio based on the total silver amount in both the first layer and the second layer (mol/mol of Ag)

While the invention has been described in detail and with reference to specific embodiments thereof, it will be apparent to one skilled in the art that various changes and modifications can be made therein without departing from the spirit and scope thereof.

What is claimed is:

1. A method for forming an image for diffusion transfer of silver salts comprising image-wise exposing a diffusion transfer photographic film material comprising at least one support, at least one surface latent image type silver halide photographic emulsion layer and at least one image-receiving layer, and developing the image-wise exposed at least one surface latent image type silver halide emulsion layer with an aqueous alkaline processing solution comprising a silver halide developing agent and a silver halide solvent in the presence of a fogging agent.

2. A method as in claim 1, wherein the silver halide emulsion layer contains silver halide grains, the fogging agent is adsorptive to the silver halide, and the fogging agent is contained in the photosensitive silver halide emulsion layer in an amount of from $10^{-8}$ to $10^{-3}$ mol per mol of silver halide.

3. A method as in claim 1, wherein the silver halide emulsion layer contains silver halide grains, the fogging agent is not adsorptive to the silver halide, and the fogging agent is contained in the photosensitive silver halide emulsion layer in an amount of from $10^{-8}$ to $10^{-3}$ mol per mol of silver halide.

4. A method as claim 1, wherein the photosensitive silver halide emulsion layer is treated with a processing composition comprising an aqueous alkaline solution containing a developing agent, a solvent for silver halide, and said fogging agent, and said fogging agent is present in an amount of from $10^{-5}$ to $10^{-1}$ mol per liter of the composition.

5. A method as in claim 1, wherein the fogging agent is represented by formula (I)

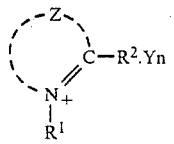

(I)

wherein Z represents a non-metallic atomic group necessary to form a 5-membered or 6-membered heterocyclic ring which may be substituted by a substituent group; $R^1$ represents an aliphatic group, $R^2$ represents a hydrogen atom, an aliphatic or aromatic group, and $R^1$ and $R^2$ each may be substituted by a substituent group, on condition that at least one of groups represented by $R^1$, $R^2$, and Z contains an alkynyl group, an acyl group, a hydrazine group,or a hydrazone group, or $R^1$ and $R^2$ form a 6-membered ring to form a dihydropyridinium skeleton; further, at least one of substituent groups of $R^1$, $R^2$, and Z may have $X^1$—$L^1{}_m$ wherein $X^1$ represents an adsorption enhancing group for silver halide, and $L^1$ represents a divalent linking group; Y represents a counterpart ion for electric charge balance; and n represents 0 or 1 and m represents 0 or 1.

6. A method as in claim 5, wherein at least one of the groups represented by $R^1$, $R^2$, and Z has an alkyl group, an acyl group, a hydrazine group, or a hydrazone group, or $R^1$ and $R^2$ forms a 6-membered ring to form a dihydropyridinium skeleton, the above-mentioned groups or 6-membered ring may be substituted by a substituent group as mentioned previously as the substituent group of Z.

7. A method as in claim 1, wherein the fogging agent is represented by formula (II)

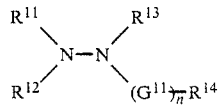

(II)

wherein $R^{11}$, $R^{12}$, and $R^{13}$ each represents a hydrogen atom, an aliphatic group, an aromatic group, an alkylsulfonyl group, an arylsulfonyl group, or an acyl group; $R^{14}$ represents a hydrogen atom, an alkyl group, an aralkyl group, an aryl group, a heterocyclic group, an alkoxy group, an aryloxy group, an amino group, or a carbamoyl group; $G^{11}$ represents a carbonyl group, a sulfonyl group, a sulfoxy group, a phosphoryl group, or an iminomethylene group

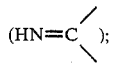

and n represents 0 or 1.

8. A method as in claim 1, wherein the fogging agent is represented by formula (III)

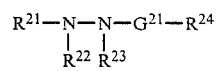

(III)

wherein $R^{21}$ represents an aliphatic group or an aromatic group; $R^{24}$ represents a hydrogen atom, an alkyl group, an aralkyl group, an aryl group, an alkoxy group, an aryloxy group, or an amino group; $G^{21}$ represents a carbonyl group, a sulfonyl group, a sulfoxy group, a phosphoryl group or an iminomethylene group $$(HN{=}C\begin{matrix}\diagup\\ \diagdown\end{matrix});$$

and $R^{22}$ and $R^{23}$ each represents a hydrogen atom, or one of $R^{22}$ and $R^{23}$ represents a hydrogen atom and the other of them represents an alkylsulfonyl group, an arylsulfonyl group, or an acyl group or $G^{21}$, $R^{22}$, $R^{23}$, and a hydrazine nitrogen may form a hydrazone structure $$(\begin{matrix}\diagdown\\ \diagup\end{matrix}N{-}N{=}C\begin{matrix}\diagup\\ \diagdown\end{matrix}).$$

9. A method as in claim 8, wherein $R^{21}$ or $R^{24}$ is a group containing a group which strengthens the adsorption on the silver surface of silver halide grains.

* * * * *